United States Patent [19]

Sawada

[11] Patent Number: 4,702,302

[45] Date of Patent: Oct. 27, 1987

[54] METHOD OF MAKING THIN ALLOY WIRE

[75] Inventor: Kazuo Sawada, Osaka, Japan

[73] Assignee: Sumitomo Electric Industries Ltd., Osaka, Japan

[21] Appl. No.: 898,835

[22] Filed: Aug. 20, 1986

Related U.S. Application Data

[63] Continuation of Ser. No. 716,137, Mar. 26, 1985, abandoned.

[30] Foreign Application Priority Data

| | | | |
|---|---|---|---|
| Feb. 23, 1983 | [JP] | Japan | 58-29969 |
| Mar. 27, 1984 | [JP] | Japan | 59-59947 |
| Aug. 22, 1984 | [JP] | Japan | 59-174368 |

[51] Int. Cl.[4] ..... B22D 11/06

[52] U.S. Cl. ..... 164/463; 164/462

[58] Field of Search ..... 164/423, 462, 463

[56] References Cited

U.S. PATENT DOCUMENTS

| | | | |
|---|---|---|---|
| 3,856,513 | 12/1974 | Chen et al. | 164/463 |
| 4,448,851 | 5/1984 | Bose et al. | 164/463 |
| 4,495,691 | 1/1985 | Masumoto et al. | 164/463 |
| 4,523,626 | 6/1985 | Masumoto et al. | 164/463 |

FOREIGN PATENT DOCUMENTS

| | | | |
|---|---|---|---|
| 57-70062 | 4/1982 | Japan | 164/463 |

*Primary Examiner*—Nicholas P. Godici
*Assistant Examiner*—Richard K. Seidel
*Attorney, Agent, or Firm*—Cushman, Darby & Cushman

[57] ABSTRACT

A method of making Ag, Au or Cu thin alloy wire comprises a first step of melting alloy containing Be with 0.001 through 1% by weight, a second step of jetting the melted alloy into a thin wire configuration through a small opening and a third step of curing the jetted alloy of a wire configuration in a fluid so that a thin alloy wire having about 0.01 through 0.2 mm diameter with simple processes and high yield.

4 Claims, 3 Drawing Figures

METHOD OF MAKING THIN ALLOY WIRE

This is a continuation of application Ser. No. 716,137, filed Mar. 26, 1985, which was abandoned upon the filing hereof.

FIELD OF THE INVENTION

The present invention relates to a method of making a thin silver, gold or copper alloy wire.

BACKGROUND OF THE INVENTION

Thin silver filaments, copper alloy filaments or gold filaments have been developed for use as connecting wires to coil windings of audio appliances, connecting wires for semiconductor devices, fuse elements, welding materials and also a decoration materials. The metallic filaments are conventionally manufactured using a plurality of processes such as melting, casting, a hot processing and cold wire drawing process which includes a surface cutting, a surface preparation and a thermal processing.

A large amount of production loss tends to occur in the conventional production of wires because of the large number of processing steps as mentioned above. Losses include, for example, sample loss. The production cost of manufacturing thin wires, particularly silver or silver alloy wires, must be very expensive because of the production losses. Also, the yields from the conventional methods are low because of the large number of processes. Moreover, the conventional method requires large and complicated equipment.

In order to improve such defects of the conventional method of the production of the wire, there is proposed a method of making a round wire by releasing a fine jet flow of molten metal into liquid. However, the jet flow of molten silver or silver alloy is unstable, the proposed method has not yet been embodied in the production of thin round metal filament.

SUMMARY OF THE INVENTION

An essential object of the present invention is to provide a method of making a thin wire directly from melted alloy with decreased number of processes so that the production costs are inexpensive and so that the desired thin wire is produced in high yields.

Another object of the present invention is to provide a method of making a thin wire using the jet flow of melted alloy.

A further object of the present invention is to provide a method of making a thin alloy conductor wire suitable for use in electronic devices with a sufficient conductivity.

According to the present invention, there is provided a method of making an alloy wire comprises a first step of melting alloy containing Be with 0.001 through 1% by weight, a second step of jetting the melted alloy into a thin wire configuration through a small opening and a third step of curing the jetted alloy of a wire configuration in a fluid.

DETAILED DESCRIPTION OF THE INVENTION

Figure 1:
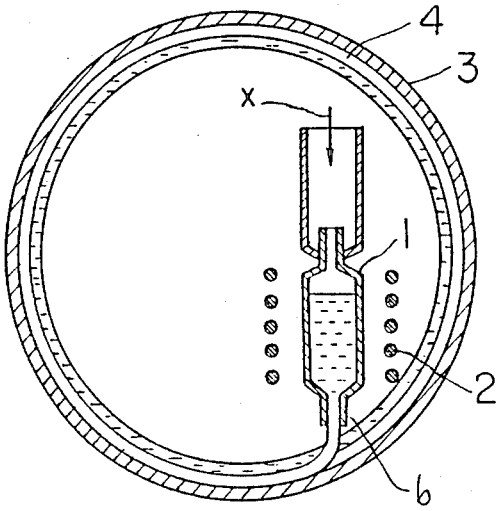
FIG. 1 is a front cross sectional view showing one example of an apparatus shown in Japanese patent publication No. 64948/1980 and employed in the method of making a round thin wire according to the present invention.
Figure 2:
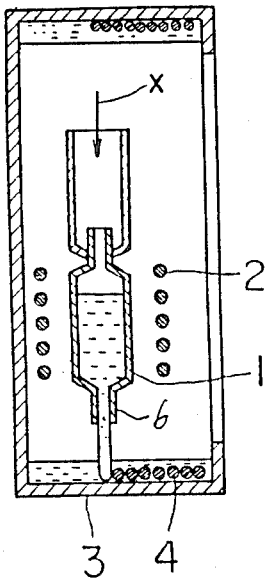
FIG. 2 is a side cross sectional view of FIG. 1.

The method of making a thin wire according to the present invention comprises a step of jetting melted alloy containing Beryllium at least 0.001 to 1% by weight through a nozzle or slit as a jet stream and a step of curing said jetted alloy by contacting the jetted alloy with a hydraulic material. Using melted alloy containing Beryllium improves the viscosity, the surface tension and the state of the surface oxidation of the melted alloy as well as the wetting against the nozzle, whereby the jet stream of the ally can be stabilized.

With the density of Beryllium contained in the alloy less than 0.001% by weight, the melted alloy is brought into particles and it is difficult to make a continuous wire. On the other hand, with the density of Beryllium contained in the alloy more than 3% by weight, there occurs a problem of increment of the material cost with the mechanical and electrical characteristic change compared to the small degree of the improvement of the flowability of the melted alloy. Therefore, the density of the Beryllium may be within the range of 0.001% through 3% by weight.

As a way of jetting the melted alloy, various known method such as rotary spinning in liquid or curing in the flowing liquid may be used. As the liquid, water and/or other hydraulic fluid may be used.

Preferably, after the thin wire is drawn, the thin wire may be subjected to a cold drawing process with an area decreasing ratio more than 5%. The cold drawing is effective to make the shape of the cross section of the wire uniform and to improve either the mechanical strength and the flexibility after softening of the wire. With the area decreasing ration less than 5%, effect of the cold drawing may not be expected.

As the main part of the alloy, silver alloy, gold alloy and copper alloy and their combination may be used.

In case of using silver alloy, the alloy may contain one or more of metals selected from a group comprising Cu, Sn, Zn, In, Au, Bi and P of less than 30% by weight depending on the use of the wire. Selection of the metal as described above enables to control the mechanical strength and melting point of the thin alloy wire.

In case of using gold alloy, alloy may contain at least one metal selected from a group comprising Si, Cu, Sn, Zn, In, Ag, Ge, Ga, Al, Pd, Pt, Pb, Mg, Fe, Ni, Co, Ca, B, Bi and P with a total amount of at most 50% by weight.

In case of using copper alloy, preferably, the melted copper alloy may contain more than one kind of metal selected from a group comprising Ag, Sn, Zr, In, Mg, Zn, Si, Mn, Ni, Fe, and Cr with at most 10% by weight. The alloy containing the material as described above enables to produce thin copper alloy wire having a desired mechanical strength and a good anti-softening characteristic.

In case of making thin copper alloy conductor wire according to the present invention, the melted copper alloy may contain more than one kind of material selected from a group consisting of Ag, Sn, Zr, In, Mg, Zn, Si, Mn, Ni, Fe and Cr with at most 1% by weight.

In case of making thin copper alloy wire according to the present invention, after curing of the wires and before or after cold process thereof, the wire may be annealed. The wire may be repeatedly subjected to a plurality of annealing processes and the cold processes.

The thin copper alloy wires produced as mentioned above may be coated by enamel material. Furthermore, preferably composition of the melted alloy may be defined so that the alloy wires have a conductivity at least 60% IACS.

EXAMPLE 1

Ag-Be alloy containing Be 0.002% by weight was melted in a graphite crucible 1 of a rotary underwater spinning machine as shown in FIG. 1. The alloy in the crucible 1 was melted by heating a heater 2 provided around the crucible 1. Then Ar gas was introduced in the crucible 1 in the direction X from above, thereby causing the melted Ag-Be alloy to be jetted by the pressure of the Ar gas through a round hole 6 defined on the bottom of the crucible 1 into a cylindrical water layer of a 15 mm thickness formed by a centrifugal force due to rotation of a rotary drum 3, whereby a round silver alloy wire having a 0.2 mm diameter was obtained.

EXAMPLE 2

A thin wire having a 0.15 mm diameter was prepared in the same manner as used in the example 1 except for using Ag alloy containing Cu 10%, Sn 5%, Zn 1%, In 1%, Au 1% and Be 0.1%. The wire was subjected to annealing continuously in a tunnel furnace and subsequently, the wire was drawn up to 0.03 mm diameter. In this case the drawing performance was good with a high productivity.

EXAMPLE 3

Figure 3:
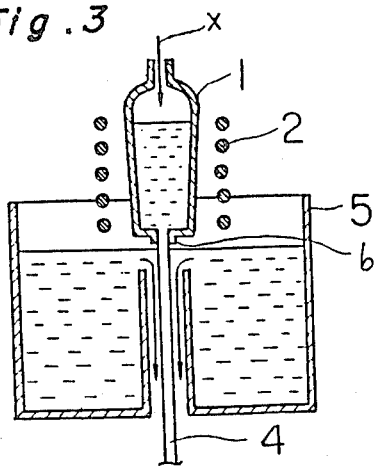
FIG. 3 is a cross sectional view showing another example of an apparatus shown in U.S. Pat. No. 3,845,805 and employed in the method of making a round thin wire according to the present invention.

Ag-Be alloy containing Be 0.5% by weight was melted in a curing device as shown in FIG. 3 wherein 1 denotes a graphite crucible, 2 denotes heaters and a tank 5 is disposed below the crucible 1 for supplying flowing water. The melted silver alloy was jetted from the crucible 1 by introducing Ar gas in X direction from above so that the melted silver alloy was drawn from the port 6 and cured by contacting the jetted silver alloy wire with water flowing from the tank 5, whereby a thin Ag-Be alloy wire having a 0.2 mm diameter was produced.

EXAMPLE 4

Au-Be alloy containing Be 0.2% by weight was melted in the same kind of the crucible 1 used in the example 1. A round gold alloy wire having a 0.2 mm diameter with a smooth surface was obtained in the same manner as described in the example 1. For the purpose of comparison, pure gold of purity of 99.99% was melted and jetted in the same manner as used in the example 1, elongated wire could not be obtained but the jetted material took shape of spherical grain.

EXAMPLE 5

An elongated thin wire having a 0.15 mm diameter was prepared by the same method as used in the example 1 except for using Au alloy containing Cu 10% Sn 5%, Zn 0.3%, In 1%, Ag 5% and Be 0.4%. The wire was subjected to annealing continuously in a tunnel furnace and subsequently, the wire was drawn up to 0.03 mm diameter. In this case the drawing performance was good with a high productivity.

EXAMPLE 6

Au-Be alloy containing both Be 0.5% by weight and impurity of Si, Ge, Co, Ga, Al, Pd, Pt, Pb, Mg, Fe, Ni, Co, Ca, B, Bi and P within 0.05 through 2% respectively with a total of 20% by weight was melted by means of a curing device as shown in FIG. 3. The melted gold alloy was jetted from the crucible 1 by introducing Ar gas in X direction from above so that the melted gold alloy was drawn from the port 6 and cured by contacting the jetted gold alloy wire with water flowing from the tank 5, whereby the thin gold alloy wire having a 0.2 mm diameter.

EXAMPLE 7

Cu-Be alloy containing Be 0.08% by weight was melted by means of the crucible 1 as shown in FIG. 1 in the same manner as described in the example 1. Subsequently Ar gas was introduced in the crucible 1 in the direction X from above, thereby causing the Cu-Be melted alloy to be jetted by the pressure of the Ar gas through a round hole 6 defined on the bottom of the crucible 1 into a rotating water stream having a cylindrical shape with 10 mm thickness flowing along the inner surface of a rotary drum 3, whereby a round copper alloy wire having a 0.2 mm diameter was obtained.

EXAMPLE 8

A Cu alloy wire having a 0.1 mm diameter was obtained by the same method as used in the example 1. The wire was drawn up to 0.05 mm diameter by a cold drawing, subsequently the drawn wire was subjected to a pre-annealer and enamel coating process. Conductivity of the conductor wire obtained as mentioned above was 85% IACS. It is therefore apparent that the conductor wire of this example has a sufficient conductivity as an electrical conductor.

EXAMPLE 9

A Cu alloy wire having a 0.1 mm diameter was obtained by the same method as used in the example 7. After the wire was annealed in a tunnel furnace continuously, the wire was drawn up to a 0.025 mm diameter. The performance of the drawing process was good with a high productivity. The wire thus processed was coated with enamel in the same manner as in the example 8 for use in conductors of electronic clocks.

EXAMPLE 10

A Cu-Be alloy containing Be 0.05% by weight was cured to obtain a Cu alloy wire having a 0.2 mm diameter by the water flow curing device as shown in FIG. 3. The Cu alloy wire was annealed with a temperature of 300° C. for 2 hours, subsequently the wire was drawn up to a 0.1 mm diameter by cold drawing and in turn the wire was coated by melted stannum Sn. In the process of coating, the wire was softened whereby a soft thin conductor wire was obtained. The conductivity of the conductor wire was 90% IACS.

What is claimed is:

1. A method of making an alloy wire comprising:

(a) melting an alloy, said alloy containing 0.001 through 0.5% by weight of Be, the remainder being Au;

(b) jetting the thus melted alloy into a thin wire configuration through a small opening; and (c) curing the thus jetted alloy by moving said jetted alloy in a fluid situated along an inner surface of a cylindrical wall of a cylindrical container while rotating said cylindrical container.

2. A method of making an alloy wire comprising:

(a) melting an alloy, said alloy containing 0.003 through 2.0% by weight of Be, the remainder being Cu;

(b) jetting the melted alloy into a thin wire configuration through a small opening; and (c) curing the thus jetted alloy by moving said jetted alloy in a fluid situated along an inner surface of a cylindrical wall of a cylindrical container while rotating said cylindrical container.

3. The method of making an alloy wire according to claim 2, wherein said alloy contains Be within 0.003 through 0.5% by weight for making a copper alloy conductor wire having a conductivity of at least 60% IACs.

4. A method of making an alloy wire comprising:

(a) melting an alloy, said alloy containing 0.001 through 0.5% by weight of Be, the remainder being Ag;

(b) jetting the thus melted alloy into a thin wire configuration through a small opening; and (c) curing the thus jetted alloy by moving said jetted alloy in a fluid situated along an inner surface of a cylindrical wall of a cylindrical container while rotating said cylindrical container.

* * * * *